US011497968B2

(12) United States Patent
Shintani

(10) Patent No.: US 11,497,968 B2
(45) Date of Patent: Nov. 15, 2022

(54) BALANCE TRAINING SYSTEM, METHOD OF CONTROLLING THE SAME, AND CONTROL PROGRAM

(71) Applicant: TOYOTA JIDOSHA KABUSHIKI KAISHA, Toyota (JP)

(72) Inventor: Kazuhiro Shintani, Toyokawa (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 126 days.

(21) Appl. No.: 17/143,718

(22) Filed: Jan. 7, 2021

(65) Prior Publication Data

US 2021/0245011 A1 Aug. 12, 2021

(30) Foreign Application Priority Data

Feb. 12, 2020 (JP) ..... JP2020-021521

(51) Int. Cl.
*A63B 26/00* (2006.01)
*A63B 22/02* (2006.01)
(Continued)

(52) U.S. Cl.
CPC ..... *A63B 26/003* (2013.01); *A63B 22/02* (2013.01); *A63B 22/025* (2015.10);
(Continued)

(58) Field of Classification Search
CPC .... A63B 22/0235–0257; A63B 22/025; A63B 22/02–0292; A63B 24/0087; A63B 24/0062; A63B 26/00–003; A63B 2220/20–22; A63B 2220/30–31; A63B 2220/40; A63B 2220/50–52; A63B 2220/80; A63B 2220/801; A63B 2220/83–833; A63B 2220/89; A63B 21/4035; A63B 2022/0092;
(Continued)

(56) References Cited

U.S. PATENT DOCUMENTS 5,299,454 A * 4/1994 Fuglewicz ..... A61B 5/1038 600/592
5,474,087 A * 12/1995 Nashner ..... G06V 40/25 600/595
(Continued)

FOREIGN PATENT DOCUMENTS

JP 6260811 B2 1/2018

*Primary Examiner* — Garrett K Atkinson
*Assistant Examiner* — Kathleen M Fisk
(74) *Attorney, Agent, or Firm* — Oliff PLC

(57) ABSTRACT

A balance training system including a mobile plate configured to support a sole of a trainee in a standing state, a first member fixed on the mobile plate, a load distribution sensor including a plurality of sensors arranged in a matrix under the mobile plate and configured to detect a load received from the trainee riding on the mobile plate and a position of the first member, and a control unit configured to calculate a net moving amount of a center of gravity position of the trainee based on a difference between a moving amount of a center of gravity position of the load received from the trainee detected by the load distribution sensor and a moving amount of the position of the first member detected by the load distribution sensor and to control a movement of the mobile plate based on a result of the calculation.

6 Claims, 4 Drawing Sheets

(51) Int. Cl.
*A63B 24/00* (2006.01)
*A63B 22/00* (2006.01)

(52) U.S. Cl.
CPC .. *A63B 24/0062* (2013.01); *A63B 2022/0092* (2013.01); *A63B 2024/0093* (2013.01); *A63B 2208/0204* (2013.01); *A63B 2220/52* (2013.01); *A63B 2220/833* (2013.01)

(58) Field of Classification Search
CPC .... A63B 2022/0094; A63B 2208/0204; A63B 71/06; A63B 2071/025; A63B 2225/50; A61B 5/1038; G06F 3/011; G06F 3/016
See application file for complete search history.

(56) References Cited

U.S. PATENT DOCUMENTS 5,902,214 A * 5/1999 Makikawa ..... G16H 20/30 482/52
7,771,321 B2 * 8/2010 Hirata ..... A63B 21/00181 482/901
7,914,420 B2 * 3/2011 Daly ..... A63B 24/00 482/901
7,980,856 B2 * 7/2011 Grabiner ..... A63B 24/00 434/258
8,002,672 B2 * 8/2011 Brunner ..... A61B 5/1038 482/8
8,206,267 B2 * 6/2012 Holden ..... A63B 21/4015 482/4
8,529,418 B2 * 9/2013 Stewart ..... A63B 24/0062 482/6
9,084,712 B2 * 7/2015 Roerdink ..... A63B 22/02
9,782,659 B2 * 10/2017 Yamazaki ..... A63B 21/285
10,967,220 B2 * 4/2021 Gouzenko ..... A63G 23/00
2004/0068211 A1 * 4/2004 Leivseth ..... A61H 23/0263 601/49
2009/0036272 A1 * 2/2009 Yoo ..... A63B 22/0257 482/7
2009/0176629 A1 * 7/2009 Yi ..... A63B 22/025 482/54
2015/0173652 A1 * 6/2015 Brunner ..... A61B 5/112 482/7
2016/0228746 A1 * 8/2016 Jayakumar ..... G16H 40/63
2019/0209891 A1 * 7/2019 Fung ..... G06F 3/0338
2021/0169726 A1 * 6/2021 Koike ..... A63B 22/025
2021/0346754 A1 * 11/2021 Brunner ..... A63B 24/0087

* cited by examiner

BALANCE TRAINING SYSTEM, METHOD OF CONTROLLING THE SAME, AND CONTROL PROGRAM

CROSS REFERENCE TO RELATED APPLICATIONS

This application is based upon and claims the benefit of priority from Japanese patent application No. 2020-021521, filed on Feb. 12, 2020, the disclosure of which is incorporated herein in its entirety by reference.

BACKGROUND

The present disclosure relates to a balance training system, a method of controlling the same, and a control program.

The rehabilitation support device disclosed in Japanese Patent No. 6260811 includes a force plate on which a subject can stand, a load detection sensor for detecting a load of the subject applied to the force plate, center of gravity position detection means for detecting a center of gravity position of the subject from the load detected by the load detection sensor, and driving means. Here, the driving means moves the force plate in accordance with the moving direction of the center of gravity of the subject.

SUMMARY

In some rehabilitation support devices, a load detection sensor that does not move in association with a mobile plate, such as a force plate, on which a subject (trainee) rides, is provided under the mobile plate.

However, in this case, a moving amount of the mobile plate moved along with a center of gravity moving amount of the subject is included in a calculation result of the center of gravity moving amount of the subject. For this reason, the net moving amount of the center of gravity position of the subject cannot be accurately calculated. As a result, there has been a problem in the related art that the subject cannot perform effective balance training, because the movement of the mobile plate cannot be accurately controlled in association with the movement of the center of gravity of the subject.

The present disclosure has been made in view of the above circumstances. An object of the present disclosure is to provide a balance training system, a method of controlling the same, and a control program capable of performing effective training.

An example aspect of the present disclosure is a balance training system including: a mobile plate configured to support a sole of a trainee in a standing state; a first member fixed on the mobile plate; a load distribution sensor including a plurality of sensors arranged in a matrix under the mobile plate and configured to detect a load received from the trainee riding on the mobile plate and a position of the first member; and a control unit configured to calculate a net moving amount of a center of gravity position of the trainee based on a difference between a moving amount of a center of gravity position of the load received from the trainee detected by the load distribution sensor and a moving amount of the position of the first member detected by the load distribution sensor and to control a movement of the mobile plate based on a result of the calculation. This balance training system can accurately control a movement of a mobile plate according to a change in the center of gravity position by calculating the net moving amount of the center of gravity position of the trainee in consideration of the moving amount of the mobile plate such as a belt. Thus, trainee can perform effective balance training.

The load distribution sensor is provided in such a way that the load distribution sensor is not moved in association with the mobile plate. Further, the first member is fixed within a range where a position of the first member can be detected by the load distribution sensor even when the mobile plate is moved.

Further, the mobile plate is a belt of a treadmill, and the load distribution sensor is provided under the belt of the treadmill.

Another example aspect of the present disclosure is a method of controlling a balance training system including: detecting, using a load distribution sensor including a plurality of sensors arranged in a matrix under a mobile plate for supporting a sole of a trainee in a standing state, a load received from the trainee riding on the mobile plate and a position of a first member fixed on the mobile plate; and calculating a net moving amount of a center of gravity position of the trainee based on a difference between a moving amount of a center of gravity position of the load received from the trainee detected by the load distribution sensor and a moving amount of the position of the first member detected by the load distribution sensor and controlling a movement of the mobile plate based on a result of the calculation. In this method of controlling the balance training system, it is possible to accurately control a movement of a mobile plate according to a change in the center of gravity position by calculating the net moving amount of the center of gravity position of the trainee in consideration of the moving amount of the mobile plate such as a belt. Thus, trainee can perform effective balance training.

Another example aspect of the present disclosure is a control program for causing a computer to execute: detecting, using a load distribution sensor including a plurality of sensors arranged in a matrix under a mobile plate for supporting a sole of a trainee in a standing state, a load received from the trainee riding on the mobile plate and a position of a first member fixed on the mobile plate; and calculating a net moving amount of a center of gravity position of the trainee based on a difference between a moving amount of a center of gravity position of the load received from the trainee detected by the load distribution sensor and a moving amount of the position of the first member detected by the load distribution sensor and controlling a movement of the mobile plate based on a result of the calculation. In this control program, it is possible to accurately control a movement of a mobile plate according to a change in the center of gravity position by calculating the net moving amount of the center of gravity position of the trainee in consideration of the moving amount of the mobile plate such as a belt. Thus, trainee can perform effective balance training.

According to the present disclosure, it is possible to provide a balance training system, a method of controlling the same, and a control program capable of performing effective balance training.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, the present disclosure will be explained through embodiments of the present disclosure. However, they are not intended to limit the scope of the present disclosure according to the claims. Further, all of the components/structures described in the embodiments are not necessarily indispensable as means for solving the problem. For clarifying the explanation, the following description and the drawings are partially omitted and simplified as appropriate. The same symbols are assigned to the same elements throughout the drawings and repeated explanations are omitted as appropriate.

First Embodiment

Figure 1:
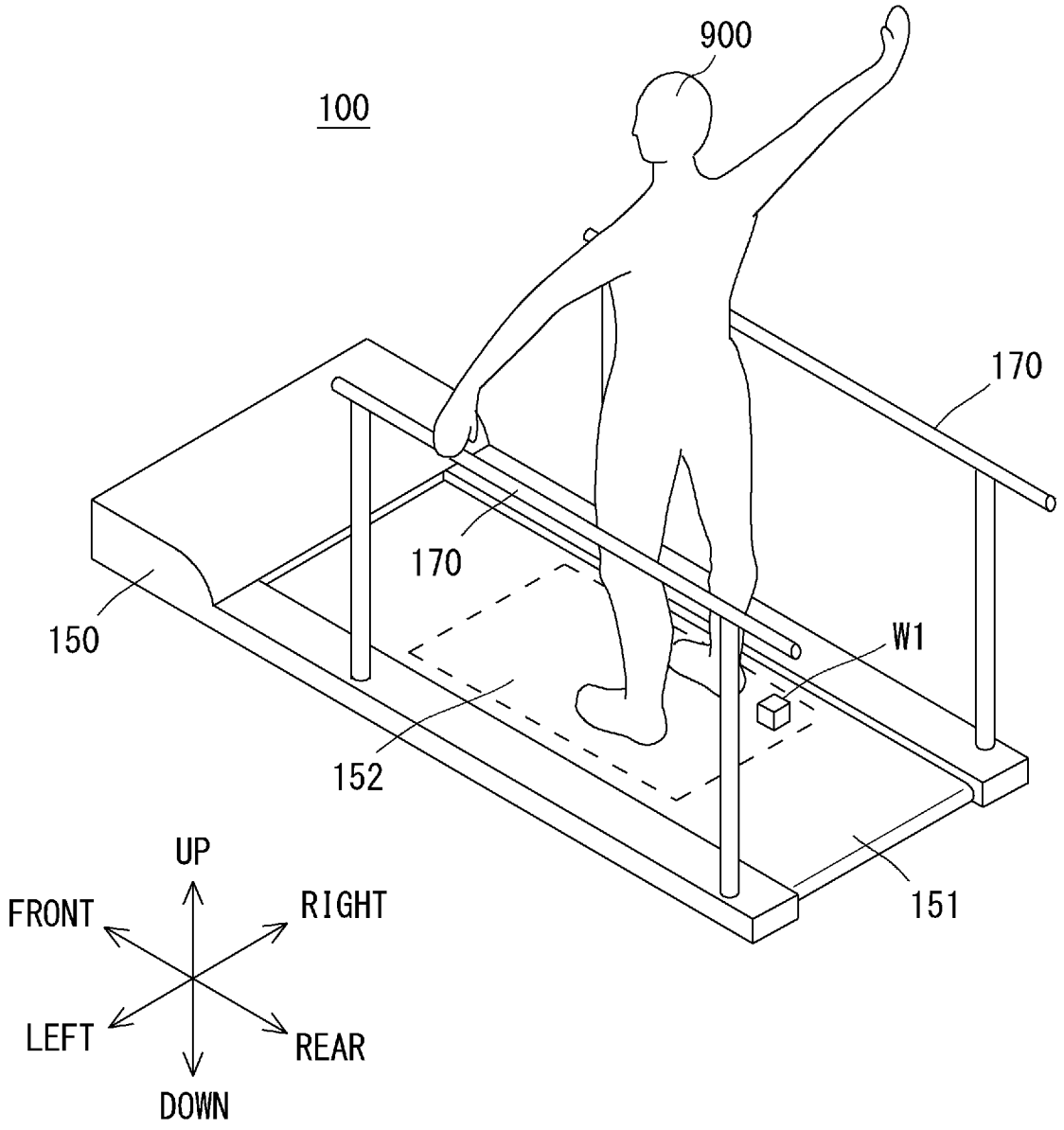
FIG. 1 is an overview perspective view of a balance training system according to a first embodiment.
Figure 2:
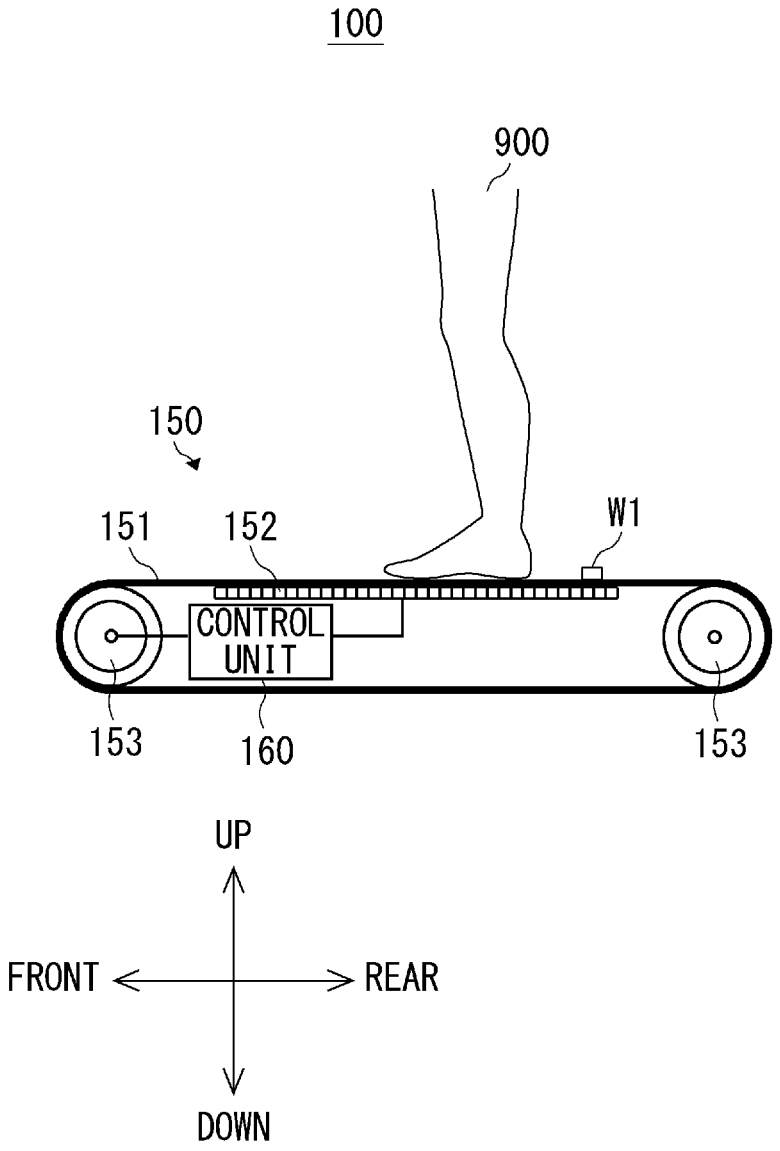
FIG. 2 is an overview side view of a part of the balance training system shown in FIG. 1.

FIG. 1 is an overview perspective view (view from diagonally backward left) of a balance training system 100 according to a first embodiment. FIG. 2 is an overview side view (view from the left) of a part of the balance training system 100. The balance training system 100 may also be referred to as a balance training device.

The balance training system 100 is a system for a trainee with a disability such as hemiplegia to learn to move his/her center of gravity, which the learning of moving is necessary for walking, or for a trainee with a disability in his/her ankle joint to recover the ankle joint function. For example, when a trainee 900 who wants to recover the ankle joint function tries to continue to stay riding on the balance training system 100 while maintaining his/her balance, the balance training system 100 can apply a load that can be expected to have a rehabilitation effect to the trainee 900's ankle joint.

Specifically, the balance training system 100 includes a treadmill 150, a load distribution sensor 152, a control unit 160, a handrail 170, and a member (a first member) W1. Note that, in the following description, the up-down direction, the right-left direction, and the front-rear direction are directions based on the orientation of the trainee 900.

The treadmill 150 includes at least a ring-shaped belt (mobile plate) 151, a pulley 153, and a motor (not shown). The load distribution sensor 152 is disposed at an inner side of the ring-shaped belt 151 (under the belt 151 on which the trainee 900 rides) in such a way that the load distribution sensor 152 does not move in association with the belt 151.

The member W1 having a predetermined weight is fixed on the belt 151. The member W1 may be any solid having a predetermined weight as long as a position of the member W1 can be detected by the load distribution sensor 152. The member W1 is fixed to a position on the belt 151 where the member W1 does not interfere with the trainee 900 when he/she rides on the belt 151, and within a range where the position of the member W1 can be detected by the load distribution sensor 151 even when the member W1 is moved in association with the movement of the belt 152.

The load distribution sensor 152 is composed of a plurality of sensors. The plurality of sensors are arranged in a matrix under the belt 151 for supporting the sole of the trainee 900 in a standing state. The load distribution sensor 152 can detect the distribution of the surface pressure received from the feet of the trainee 900 who rides on the belt 151 and the surface pressure received from the member W1 fixed to the belt 151 using the plurality of sensors. Thus, the load distribution sensor 152 can detect the loads received from the feet of the trainee 900 who rides on the belt 151 and the position of the member W1.

The handrail 170 is provided so as to be positioned, for example, on the side of the trainee 900 so that it can be graped when he/she is about to lose his/her balance or when he/she feels uneasy.

The control unit 160 calculates the center of gravity position of the trainee 900 based on the load received from the trainee 900 detected by the load distribution sensor 152, and rotates the pulley 153 at a speed, a direction, and an amount in accordance with a mobile vector (moving direction and moving amount) of the calculated center of gravity position, thereby rotating the ring-shaped belt 151. The trainee 900 standing on the belt 151 also moves with the rotation (movement) of the belt 151.

Here, the control unit 160 further calculates a moving amount (mobile vector) of the position of the member W1 detected by the load distribution sensor 152. This enables calculation of the moving amount of the belt 151 (mobile vector) that has moved along with the movement of the center of gravity position of the trainee 900. Then, the control unit 160 subtracts the moving amount of the position of the member W1 from the moving amount of the center of gravity position of the trainee 900 calculated based on the load received from the trainee 900, thereby calculating the net moving amount of the center of gravity position of the trainee 900. The control unit 160 rotates the pulley 153 in accordance with the net moving amount of the center of gravity position of the trainee 900, thereby accurately rotating the ring-shaped belt 151.

In this manner, in the balance training system 100, the control unit 160 subtracts the moving amount of the position of the member W1 detected by the load distribution sensor 152 from the moving amount of the center of gravity position of the trainee 900 calculated based on the load received from the trainee 900, thereby calculating the net moving amount of the center of gravity position of the trainee 900. Since the balance training system 100 can accurately rotate (move) the belt 151 using the net moving amount of the center of gravity position, the subject can perform effective balance training.

The moving amount of the belt 151 can also be calculated from an encoder of the motor for driving the belt 151. However, there is a possibility that there may be a difference between the timing at which the information about the moving amount of the belt is acquired from the encoder and the timing at which the information about the center of gravity moving amount is acquired from the load distribution sensor 152, due to a difference between amounts of delay. On the other hand, in the balance training system 100, since the information about the moving amount of the belt and the information about the center of gravity moving amount are both acquired from the load distribution sensor 152, there is no difference between these timings at which the information is acquired. Therefore, the balance training system 100 can accurately calculate the net moving amount of the center of gravity position of the trainee 900.

Next, an operation of the balance training system 100 will be described with reference to FIGS. 3 and 4.

Figure 3:
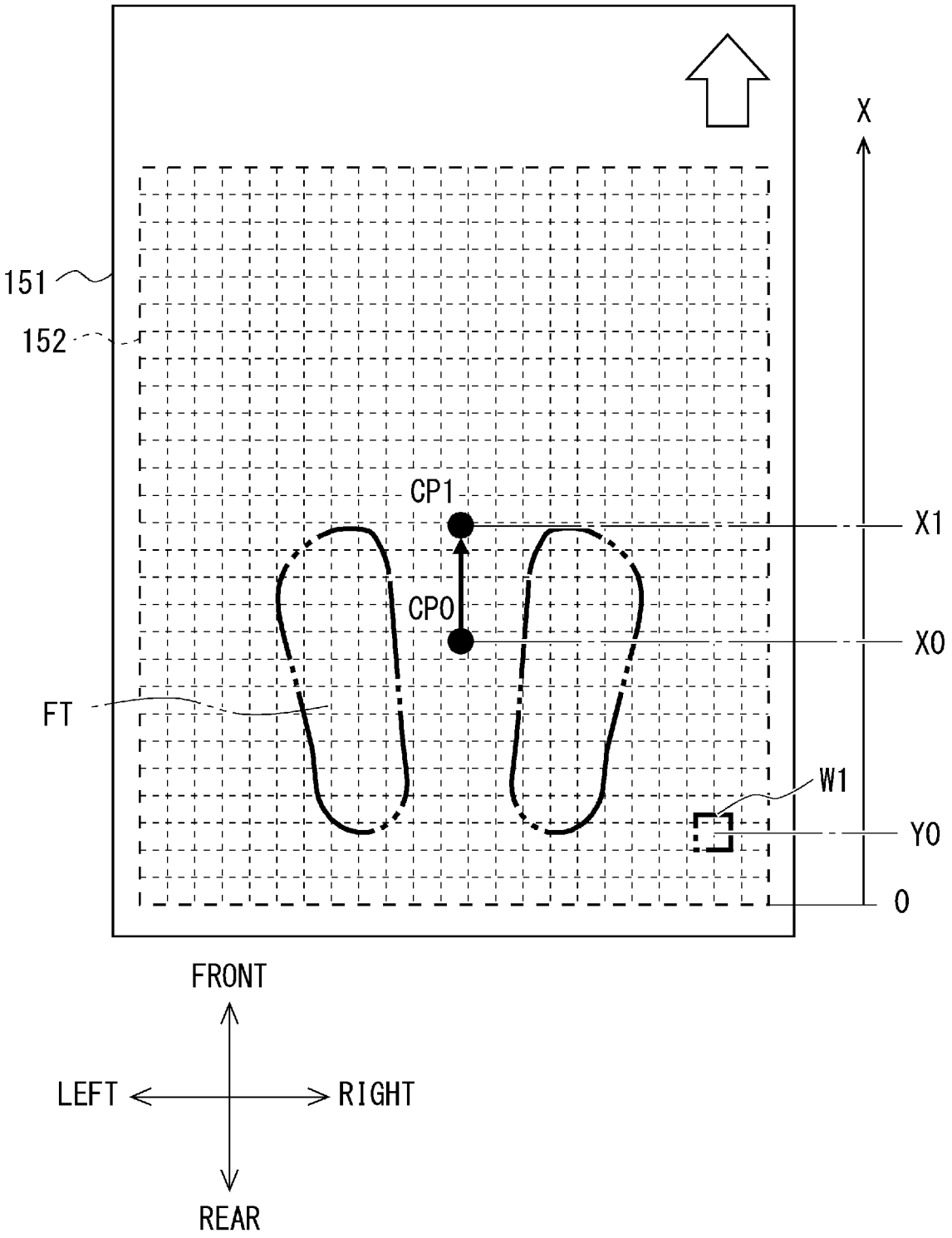
FIG. 3 is a diagram for explaining an operation of the balance training system shown in FIG. 1.
Figure 4:
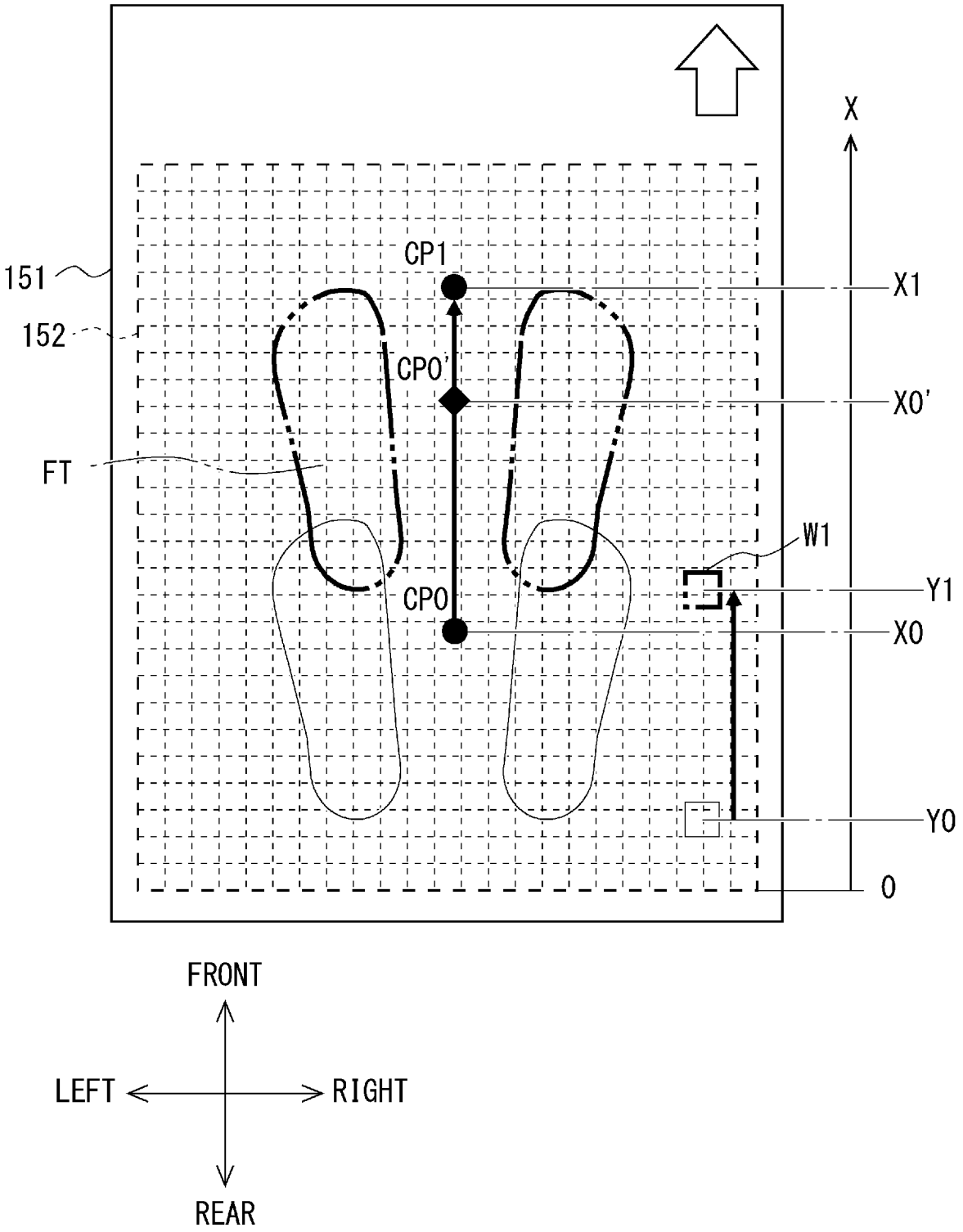
FIG. 4 is a diagram for explaining an operation of the balance training system shown in FIG. 1.

FIGS. 3 and 4 are diagrams for explaining the operation of the balance training system 100. FIG. 3 shows the state before the belt 151 is moved. FIG. 4 shows the state after the belt 151 is moved along with the movement of the center of gravity of the trainee 900 shown in FIG. 3.

First, a state before the belt 151 is moved will be described with reference to FIG. 3.

Before the training is started, the trainee 900 brings his/her sole to a specified position in a central part of the belt 151 and thus his/her state becomes a stationary standing state. When the training is started, the trainee 900 performs training to maintain his/her balance by attempting to move his/her center of gravity without moving the sole from the position where the sole is brought into contact with the belt 151.

The control unit 160 calculates the center of gravity position CP0 of the trainee 900 in the stationary standing state before the training is started. Specifically, the control unit 160 calculates the center of gravity position CP0 of the trainee 900 from the loads received from the left and right feet FT of the trainee 900 detected by the load distribution sensor 152.

When the training is started, the control unit 160 periodically calculates the center of gravity position CP1 of the trainee 900 during the balance training. In the example of FIG. 3, during the balance training, the trainee 900 inclines his/her weight to forward more than when he/she is in the stationary standing state. Thus, the center of gravity position CP1 is positioned forward of the initial center of gravity position CP0.

The control unit 160 rotates the belt 151 in accordance with the mobile vector (the solid arrow in FIG. 3) from the center of gravity position CP0 to the center of gravity position CP1. The trainee 900 standing on the belt 151 also moves with the rotation of the belt 151. In this example, the belt 151 can rotate only in the front-rear direction.

The X-axis shown in FIG. 3 indicates the position of the center of gravity in the front-rear direction when the rear end of the rectangular load distribution sensor 152 is defined as a starting point. In the example of FIG. 3, the initial position of the center of gravity CP0 is the position X0, and the position of the center of gravity CP1 is the position X1. The control unit 160 rotates the belt 151 forward or backward according to the difference between the positions X1 and X0. In the example of FIG. 3, the control unit 160 rotates the belt 151 forward according to the difference between the positions X1 and X0. Thus, the trainee 900 standing on the belt 151 also moves forward.

Next, the state after the belt 151 is moved along with the movement of the center of gravity of the trainee 900 shown in FIG. 3 will be described with reference to FIG. 4.

As shown in FIG. 4, when the belt 151 is moved along with the movement of the center of gravity of the trainee 900, the center of gravity moving amount of the trainee 900 (X1−X0 in FIG. 4) calculated based on the load received from the trainee 900 includes the moving amount of the belt 151.

Thus, the control unit 160 further calculates the moving amount of the position of the member W1 (Y1−Y0 in FIG. 4) detected by the load distribution sensor 152 as the moving amount of the belt 151 which has moved along with the movement of the center of gravity of the trainee 900. Then, the control unit 160 subtracts the moving amount of the position of the member W1 (Y1−Y0) from the center of gravity moving amount of the trainee 900 (X1−X0) calculated based on the load received from the trainee 900, thereby calculating the net moving amount of the center of gravity position of the trainee 900 (X1−X0' in FIG. 4).

After that, the control unit 160 rotates the belt 151 based on the net moving amount (X1−X0') of the center of gravity position of the trainee 900.

Thus, in the balance training system 100, the control unit 160 subtracts the moving amount of the position of the member W1 detected by the load distribution sensor 152 from the moving amount of the center of gravity position of the trainee 900 calculated based on the load received from the trainee 900, thereby calculating the net moving amount of the center of gravity position of the trainee 900. The balance training system 100 can accurately rotate (move) the belt 151 using the net moving amount of the center of gravity position, and thus the subject can perform effective balance training.

The present disclosure is not limited to the embodiment described above, and may be modified as appropriate without departing from the spirit of the disclosure.

In this embodiment, a case in which the control unit 160 rotates the belt 151 in the front-rear direction in accordance with the mobile vector from the center of gravity CP0 (or CP0') to the center of gravity CP1 has been described as an example. However, the present disclosure is not limited to this. If the belt 151 is configured to be rotatable not only in the front-rear direction but also in the right-left direction, the control unit 160 can rotate the belt 151 in the front-rear and right-left directions in accordance with the mobile vector from the center of gravity CP0 (or CP0') to the center of gravity CP1.

In the first embodiment, an example in which the control unit 160 is included in the treadmill 150 has been explained. However, the present disclosure is not limited to this. The control unit 160 may be provided outside the treadmill 150, or may be configured to remotely control the treadmill 150.

Further, although the present disclosure has been explained in the above embodiments as a hardware configuration, the present disclosure is not limited to this. The present disclosure can be realized by causing a CPU (Central Processing Unit) to execute a computer program for controlling a balance training system.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training system comprising:

a mobile plate configured to support a sole of a trainee in a standing state;

a first member fixed on the mobile plate;

a load distribution sensor including a plurality of sensors arranged in a matrix under the mobile plate and configured to detect a load received from the trainee riding on the mobile plate and a position of the first member; and a control unit configured to calculate a net moving amount of a center of gravity position of the trainee based on a difference between a moving amount of a center of gravity position of the load received from the trainee detected by the load distribution sensor and a moving amount of the position of the first member detected by the load distribution sensor and to control a movement of the mobile plate based on a result of the calculation.

2. The balance training system according to claim 1, wherein the load distribution sensor is provided in such a way that the load distribution sensor is not moved in association with the mobile plate.

3. The balance training system according to claim 1, wherein the first member is fixed within a range where a position of the first member is configured to be detected by the load distribution sensor even when the mobile plate is moved.

4. The balance training system according to claim 1, wherein the mobile plate is a belt of a treadmill, and the load distribution sensor is provided under the belt of the treadmill.

5. A method of controlling a balance training system comprising:

detecting, using a load distribution sensor including a plurality of sensors arranged in a matrix under a mobile plate for supporting a sole of a trainee in a standing state, a load received from the trainee riding on the mobile plate and a position of a first member fixed on the mobile plate; and calculating a net moving amount of a center of gravity position of the trainee based on a difference between a moving amount of a center of gravity position of the load received from the trainee detected by the load distribution sensor and a moving amount of the position of the first member detected by the load distribution sensor and controlling a movement of the mobile plate based on a result of the calculation.

6. A non-transitory computer readable medium storing a control program for causing a computer to execute:

detecting, using a load distribution sensor including a plurality of sensors arranged in a matrix under a mobile plate for supporting a sole of a trainee in a standing state, a load received from the trainee riding on the mobile plate and a position of a first member fixed on the mobile plate; and calculating a net moving amount of a center of gravity position of the trainee based on a difference between a moving amount of a center of gravity position of the load received from the trainee detected by the load distribution sensor and a moving amount of the position of the first member detected by the load distribution sensor and controlling a movement of the mobile plate based on a result of the calculation.

* * * * *